US010458266B2

(12) United States Patent
Carlson et al.

(10) Patent No.: US 10,458,266 B2
(45) Date of Patent: Oct. 29, 2019

(54) FORWARD FACING TANGENTIAL ONBOARD INJECTORS FOR GAS TURBINE ENGINES

(71) Applicant: United Technologies Corporation, Farmington, CT (US)

(72) Inventors: Daniel Carlson, Vernon, CT (US); Jonathan Ortiz, Torrance, CA (US); Matthew A. Devore, Rocky Hill, CT (US); Raymond Surace, Newington, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 290 days.

(21) Appl. No.: 15/490,304

(22) Filed: Apr. 18, 2017

(65) Prior Publication Data

US 2018/0298774 A1 Oct. 18, 2018

(51) Int. Cl.
*F01D 5/08* (2006.01)
*F01D 11/04* (2006.01)
(Continued)

(52) U.S. Cl.
CPC ..... *F01D 11/04* (2013.01); *F01D 5/06* (2013.01); *F01D 5/082* (2013.01); *F01D 9/041* (2013.01);
(Continued)

(58) Field of Classification Search
CPC ..... F01D 5/082; F01D 11/00; F01D 11/001; F01D 11/008; F01D 11/02; F01D 9/041;
(Continued)

(56) References Cited

U.S. PATENT DOCUMENTS 4,666,368 A 5/1987 Hook et al.
5,402,636 A * 4/1995 Mize ..... F01D 3/00 415/115
(Continued)

FOREIGN PATENT DOCUMENTS

EP 1380723 A1 * 1/2004 ..... F01D 5/082
EP 1380723 A1 1/2004
(Continued)

OTHER PUBLICATIONS

Machine Translation of EP 1380723 A1 (Year: 2004).*
(Continued)

*Primary Examiner* — Ninh H. Nguyen
(74) *Attorney, Agent, or Firm* — Cantor Colburn LLP

(57) ABSTRACT

Gas turbine engines and turbines thereof including a stator section having a plurality of vanes, a rotating section having a plurality of blades, the rotating section being axially adjacent the stator section along an axis of the turbine, the stator section being aftward of the rotating section along the axis of the turbine, and a primary tangential onboard injector located radially inward from the stator section and configured to direct an airflow from the stator section in a forward direction toward the rotating section, the primary tangential onboard injector turning the airflow in a direction of rotation of the rotating section.

12 Claims, 6 Drawing Sheets

(51) Int. Cl.
*F01D 5/06* (2006.01)
*F01D 9/04* (2006.01)
*F01D 11/00* (2006.01)

(52) U.S. Cl.
CPC ..... *F01D 11/001* (2013.01); *F05D 2220/32* (2013.01); *F05D 2240/128* (2013.01); *F05D 2240/56* (2013.01); *F05D 2260/14* (2013.01)

(58) Field of Classification Search
CPC ..... F05D 2220/32; F05D 2240/128; F05D 2240/56; F05D 2260/14
See application file for complete search history.

(56) References Cited

U.S. PATENT DOCUMENTS 6,082,961 A * 7/2000 Anderson ..... F01D 5/08 415/115
6,179,555 B1 1/2001 Tremaine
7,625,171 B2 * 12/2009 Maguire ..... F01D 5/081 415/115
7,874,799 B2 1/2011 Young et al.
8,079,803 B2 12/2011 Takamura et al.
8,381,533 B2 2/2013 Smoke et al.
8,690,527 B2 * 4/2014 Matwey ..... F01D 11/02 415/173.7
8,899,924 B2 * 12/2014 Alvanos ..... F01D 5/081 416/116
8,926,267 B2 * 1/2015 Lee ..... F01D 5/187 415/115
9,080,449 B2 * 7/2015 Bridges ..... F01D 5/082
9,631,509 B1 * 4/2017 Lee ..... F01D 11/04
2004/0148943 A1 8/2004 Laurello et al.
2006/0222486 A1 10/2006 Maguire et al.
2008/0041064 A1 2/2008 Moore et al.
2008/0095616 A1 4/2008 Alvanos et al.
2016/0177830 A1 * 6/2016 Guardi ..... F01D 5/18 60/782
2016/0208926 A1 * 7/2016 Davis ..... F02C 7/28

FOREIGN PATENT DOCUMENTS

EP 1533473 A1 5/2005
EP 1921292 A2 5/2008

OTHER PUBLICATIONS

European Search Report, European Application No. 18167831.9, dated Jun. 20, 2018, European Patent Office; EP Search Report 8 pages.

* cited by examiner

FORWARD FACING TANGENTIAL ONBOARD INJECTORS FOR GAS TURBINE ENGINES

BACKGROUND

The subject matter disclosed herein generally relates to cooling flow in gas turbine engines and, more particularly, to forward facing tangential onboard injectors.

In gas turbine engines, tangential onboard injectors (TOBI) are used to direct cooling air toward a rotating disc that supports a plurality of turbine blades. The TOBI is configured to swirl secondary flow cooling air in a direction that is parallel to or along a direction of rotation of the rotating disc. Because of this, leakage flow into a primary or main gaspath that flows through the turbine section will be substantially parallel. That is, TOBI cooling air that leaks from the cooling areas below the gaspath are inserted into the gaspath in the same swirl direction as the rotating rotor.

Because the TOBI is located forward of or in front of the rotating disc, in an axial direction of a gas turbine engine, a vane in the gaspath will turn (swirl) the gaspath air in the same direction of the rotating rotor. Likewise, the leakage air in front of the blade that is swirled by the TOBI, enters the gaspath in the same tangential flow direction. So when the two flows (gaspath and leakage) mix with each other at the inner diameter of the gaspath, both flows are swirling in the same direction.

However, it may be advantageous to control the mixing flow of TOBI leakage flow, particularly as various new engine configurations are designed.

SUMMARY

According to some embodiments, turbines are provided. The turbines include a stator section having a plurality of vanes, a rotating section having a plurality of blades, the rotating section being axially adjacent the stator section along an axis of the turbine, the stator section being aftward of the rotating section along the axis of the turbine, and a primary tangential onboard injector located radially inward from the stator section and configured to direct an airflow from the stator section in a forward direction toward the rotating section, the primary tangential onboard injector turning the airflow in a direction of rotation of the rotating section.

In addition to one or more of the features described herein, or as an alternative, further embodiments of the turbines may include a rim cavity defined between the stator section and the rotating section, the rim cavity arranged to turn a leakage flow in a direction of a gaspath flowing from the blades toward the vanes.

In addition to one or more of the features described herein, or as an alternative, further embodiments of the turbines may include that a leakage flow passes between the stator section and the rotating section and into a gaspath flowing from the blades toward the vanes, the turbine further comprising a secondary tangential onboard injector positioned in a flow path of the leakage flow.

In addition to one or more of the features described herein, or as an alternative, further embodiments of the turbines may include that the secondary tangential onboard injector turns the leakage flow such that when the leakage flow enters the gaspath, the direction of leakage flow is in the flow direction of the gaspath flow.

In addition to one or more of the features described herein, or as an alternative, further embodiments of the turbines may include that the secondary tangential onboard injector has a first wall and a second wall, wherein the first wall is fixed to a vane element surface that is part of the stator section and the second wall is fixed to the first wall by a fixed airfoil meant to turn the leakage air in the flow direction of the gaspath flow.

In addition to one or more of the features described herein, or as an alternative, further embodiments of the turbines may include that the rotating surface includes a rotating seal that forms a seal between the rotating surface and the second wall.

In addition to one or more of the features described herein, or as an alternative, further embodiments of the turbines may include that the rotating seal is a brush seal, knife edge seal, or axial non-contact seal.

In addition to one or more of the features described herein, or as an alternative, further embodiments of the turbines may include a restrictive flow seal positioned downstream from the secondary TOBI along the flow path of the leakage flow.

In addition to one or more of the features described herein, or as an alternative, further embodiments of the turbines may include that the restrictive flow seal is a brush seal, knife edge seal, or axial non-contact seal.

According to some embodiments, gas turbine engines having a turbine are provided. The gas turbine engines include a stator section having a plurality of vanes, a rotating section having a plurality of blades, the rotating section being axially adjacent the stator section along an axis of the gas turbine engine, the stator section being aftward of the rotating section along the axis of the gas turbine engine, and a primary tangential onboard injector located radially inward from the stator section and configured to direct an airflow from the stator section in a forward direction toward the rotating section, the primary tangential onboard injector turning the airflow in a direction of rotation of the rotating section.

In addition to one or more of the features described herein, or as an alternative, further embodiments of the gas turbine engines may include a rim cavity defined between the stator section and the rotating section, the rim cavity arranged to turn a leakage flow in a direction of a gaspath flowing from the blades toward the vanes.

In addition to one or more of the features described herein, or as an alternative, further embodiments of the gas turbine engines may include that a leakage flow passes between the stator section and the rotating section and into a gaspath flowing from the blades toward the vanes, the gas turbine engine further comprising a secondary tangential onboard injector positioned in a flow path of the leakage flow.

In addition to one or more of the features described herein, or as an alternative, further embodiments of the gas turbine engines may include that the secondary tangential onboard injector turns the leakage flow such that when the leakage flow enters the gaspath, the direction of leakage flow is in the flow direction of the gaspath flow.

In addition to one or more of the features described herein, or as an alternative, further embodiments of the gas turbine engines may include that the secondary tangential onboard injector has a first wall and a second wall, wherein the first wall is fixed to a vane element surface that is part of the stator section and the second wall is fixed to the first wall by a fixed airfoil meant to turn the leakage air in the flow direction of the gaspath flow.

In addition to one or more of the features described herein, or as an alternative, further embodiments of the gas turbine engines may include that the rotating surface includes a rotating seal that forms a seal between the rotating surface and the second wall.

In addition to one or more of the features described herein, or as an alternative, further embodiments of the gas turbine engines may include that the rotating seal is a brush seal, knife edge seal, or axial non-contact seal.

In addition to one or more of the features described herein, or as an alternative, further embodiments of the gas turbine engines may include a restrictive flow seal positioned downstream from the secondary TOBI along the flow path of the leakage flow.

In addition to one or more of the features described herein, or as an alternative, further embodiments of the gas turbine engines may include that the restrictive flow seal is a brush seal, knife edge seal, or axial non-contact seal.

In addition to one or more of the features described herein, or as an alternative, further embodiments of the gas turbine engines may include a second stator section having a plurality of vanes, a second rotating section having a plurality of blades, the second rotating section being axially adjacent the second stator section along an axis of the gas turbine engine and after of the first stator section, the second stator section being aftward of the second rotating section along the axis of the gas turbine engine, and a second primary tangential onboard injector located radially inward from the second stator section and configured to direct an airflow from the second stator section in a forward direction toward the second rotating section, the second primary tangential onboard injector turning the airflow in a direction of rotation of the second rotating section.

In addition to one or more of the features described herein, or as an alternative, further embodiments of the gas turbine engines may include that a leakage flow passes between the second stator section and the second rotating section and into the gaspath, the gas turbine engine further comprising a second secondary tangential onboard injector positioned in a flow path of the leakage flow between the second stator section and the second rotating section.

Technical effects of embodiments of the present disclosure include gas turbine engines having turbine sections with forward facing tangential onboard injectors (TOBI) that are positioned aft of a rotating disc to be cooled by air from the TOBI. Further technical effects include turbine sections having primary and secondary TOBI arrangements to provide flow direction control to avoid losses in air flow within the turbine section of gas turbine engines.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
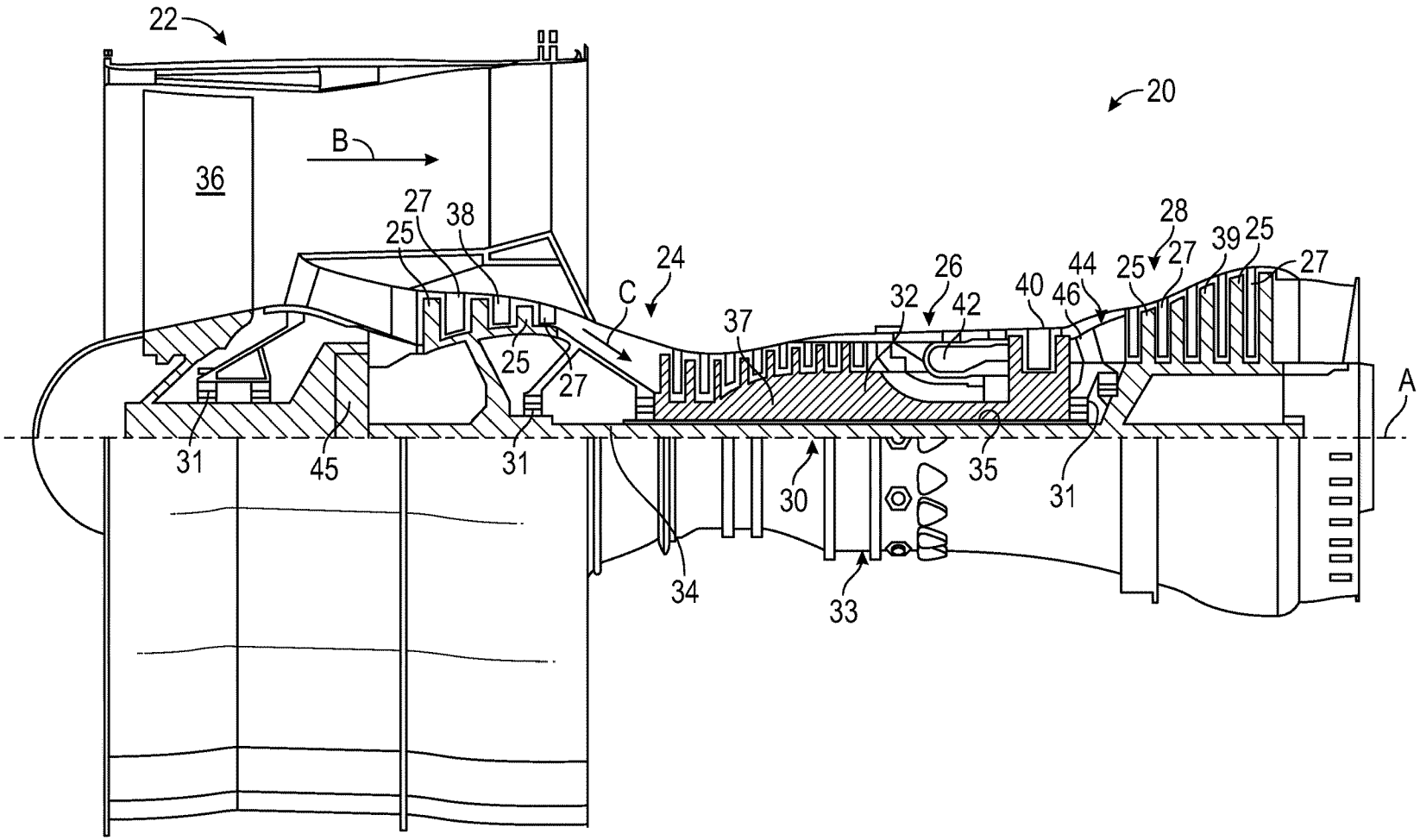
FIG. 1A is a schematic cross-sectional view of a gas turbine engine that may employ various embodiments disclosed herein.

FIG. 1A schematically illustrates a gas turbine engine 20. The exemplary gas turbine engine 20 is a two-spool turbofan engine that generally incorporates a fan section 22, a compressor section 24, a combustor section 26, and a turbine section 28. Alternative engines might include an augmenter section (not shown) among other systems for features. The fan section 22 drives air along a bypass flow path B, while the compressor section 24 drives air along a core flow path C (also referred to as "gaspath C") for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded through the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In this embodiment of the example gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(T_{ram}° R)/(518.7° R)]^{0.5}$, where T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require internal cooling circuits for cooling the parts during engine operation. Example cooling circuits that include features such as partial cavity baffles are discussed below.

Figure 1B:
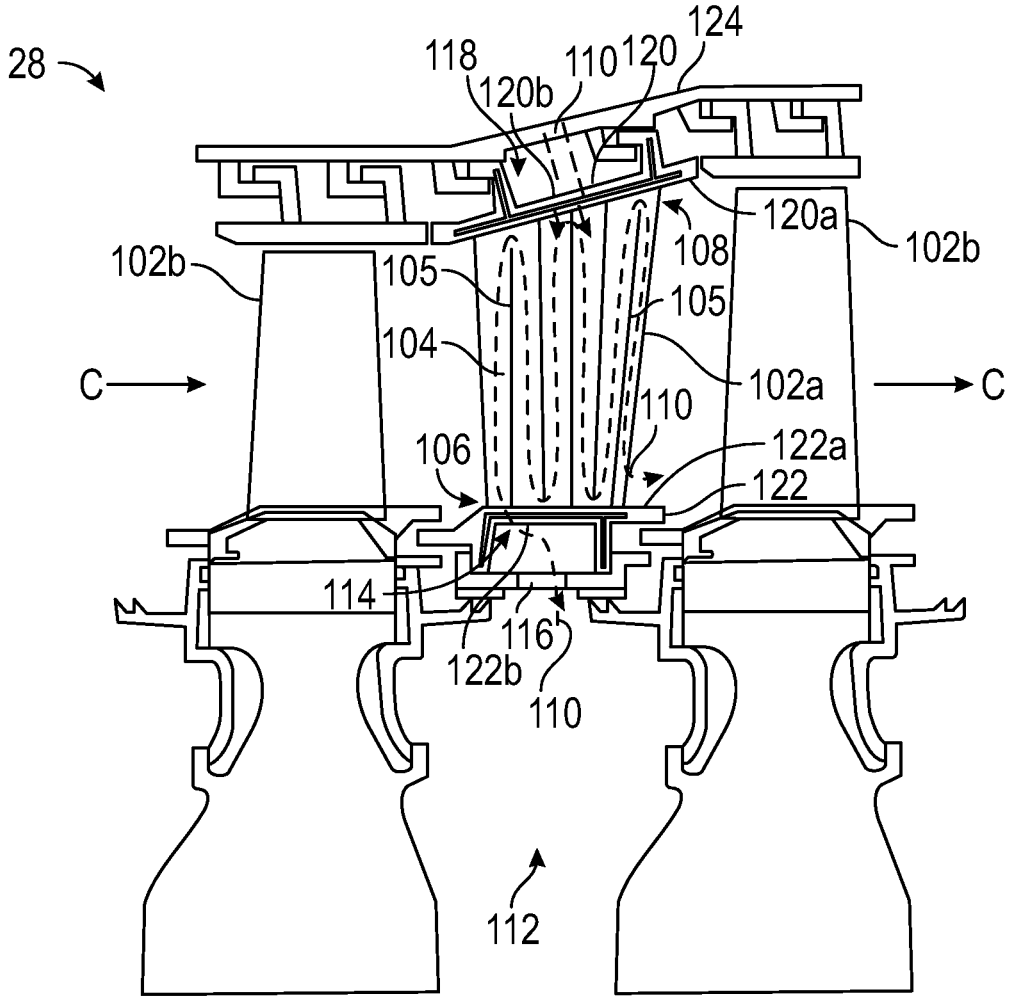
FIG. 1B is a partial schematic view of a turbine section of the gas turbine engine of FIG. 1A.

FIG. 1B is a partial schematic view of the turbine section 28 of the gas turbine engine 20 shown in FIG. 1A. Turbine section 28 includes one or more airfoils 102*a*, 102*b*. As shown, some airfoils 102*a* are stationary stator vanes and other airfoils 102*b* are blades on rotating discs. The stator vanes 102*a* are part of a stator section or portion of the turbine section 28. The stator section includes the stator vanes 102*a* that are configured to be stationary within the turbine section 28 and to direct air that flows between the blades 102*b*. The stator section 102*a* can include platforms, hooks, flow surfaces, cooling circuits, on-board injectors, seals, and other components as known in the art. The blades 102*b* are fixed to, mounted to, and/or integrally part of rotating turbine discs that rotatably drive a shaft of the gas turbine engine and form a rotating section of the turbine section 28.

The airfoils 102*a*, 102*b* are hollow body airfoils with one or more internal cavities defining a number of cooling channels 104 (schematically shown in vane 102*a*). The airfoil cavities 104 are formed within the airfoils 102*a*, 102*b* and extend from an inner diameter 106 to an outer diameter 108, or vice-versa. The airfoil cavities 104, as shown in the vane 102*a*, are separated by partitions 105 that extend either from the inner diameter 106 or the outer diameter 108 of the vane 102*a*. The partitions 105, as shown, extend for a portion of the length of the vane 102*a* to form a serpentine passage within the vane 102*a*. As such, the partitions 105 may stop or end prior to forming a complete wall within the vane 102*a*. Thus, each of the airfoil cavities 104 may be fluidly connected. In other configurations, the partitions 105 can extend the full length of the respective airfoil. Although not shown, those of skill in the art will appreciate that the blades 102*b* can include similar cooling passages formed by partitions therein.

As shown, counting from a leading edge on the left, the vane 102*a* may include six airfoil cavities 104 within the hollow body: a first airfoil cavity on the far left followed by a second airfoil cavity immediately to the right of the first airfoil cavity and fluidly connected thereto, and so on. Those of skill in the art will appreciate that the partitions 105 that separate and define the airfoil cavities 104 are not usually visible and FIG. 1B is merely presented for illustrative and explanatory purposes.

The airfoil cavities 104 are configured for cooling airflow to pass through portions of the vane 102*a* and thus cool the vane 102*a*. For example, as shown in FIG. 1B, a cooling airflow path 110 is indicated by a dashed line. In the configuration of FIG. 1B, air flows from outer diameter cavity 118. The air then flows through the airfoil cavities 104 as indicated by the cooling airflow path 110. Air is also passed into an airfoil inner diameter cavity 114, through an orifice 116, to rotor cavity 112.

As shown in FIG. 1B, the vane 102*a* includes an outer diameter platform 120 and an inner diameter platform 122. The vane platforms 120, 122 are configured to enable attachment within and to the gas turbine engine. For example, as appreciated by those of skill in the art, the inner diameter platform 122 can be mounted between adjacent rotor discs and the outer diameter platform 120 can be mounted to a case 124 of the gas turbine engine. As shown, the outer diameter cavity 118 is formed between the case 124 and the outer diameter platform 120. Those of skill in the art will appreciate that the outer diameter cavity 118 and the inner diameter cavity 114 are outside of or separate from the core flow path C. The cavities 114, 118 are separated from the core flow path C by the platforms 120, 122. Thus, each platform 120, 122 includes a respective core gas path surface 120*a*, 122*a* and a non-gas path surface 120*b*, 122*b*. The body of the vane 102*a* extends from and between the gas path surfaces 120*a*, 122*a* of the respective platforms 120, 122. In some embodiments, the platforms 120, 122 and the body of the vane 102*a* are a unitary body.

Air is passed through the airfoil cavities of the airfoils to provide cooling airflow to prevent overheating of the airfoils and/or other components or parts of the gas turbine engine. The cooling air for the blade 102*b* can be supplied from a tangential on-board injector ("TOBI") attached to the vane 102*a* via path 110, through orifice 116. As will be appreciated by those of skill in the art, a TOBI typically injects air from forward of a rotor, e.g., from proximate the combustor section forward of the turbine section. The TOBI can be configured to swirl secondary flow cooling air in the direction of the rotating direction of the rotor being cooled. Because of this, inner diameter rim cavity leakage that can result from TOBI air is also inserted into the gaspath C at the same swirl direction as the rotating rotor (e.g., on the left side of FIG. 1B).

Figure 2A:
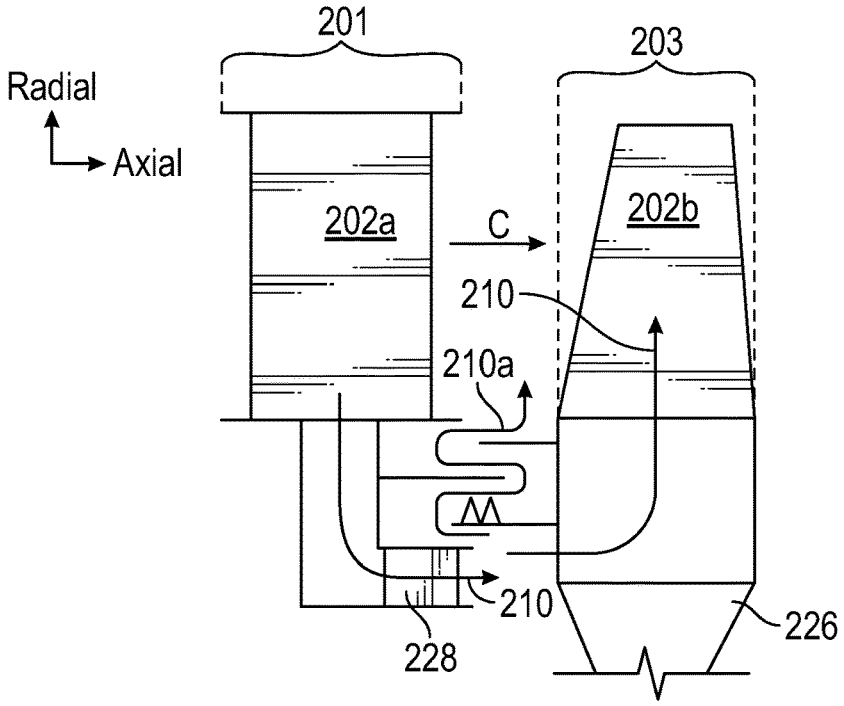
FIG. 2A (Prior Art)
FIG. 2A is a side schematic illustration showing a vane, a blade, and an aft-facing, forward located TOBI in accordance with traditional engine configurations.
Figure 2B:
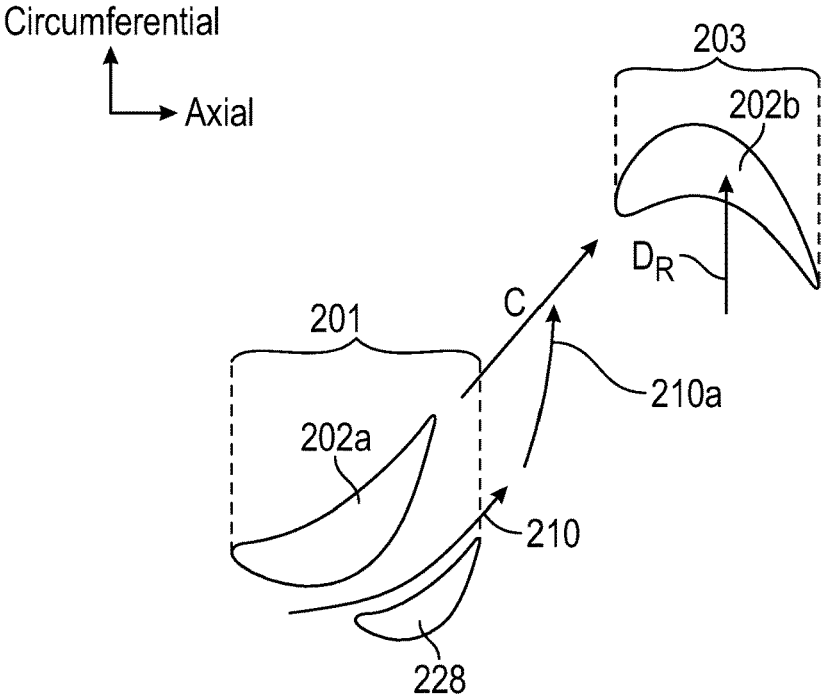
FIG. 2B (Prior Art)
FIG. 2B is a top-down, radially inward viewed schematic illustration of a cooling airflow path as it passes through the arrangement shown in FIG. 2A.

For example, turning to FIGS. 2A-2B, schematic illustrations of a forward positioned TOBI and associated airflow are shown. FIG. 2A is a side schematic illustration showing a vane 202*a* of a stator section 201 and a blade 202*b* of a rotating section 203 of a turbine of a gas turbine engine. As shown, the stator section 201 is forward of the rotating section 203, and thus the blade 202*b* is aft of the vane 202*a*. The blade 202*b* rotates on a rotor disc 226 in a rotational direction $D_R$ (as shown in FIG. 2B). An aft-facing, forward located TOBI 228 is positioned forward of the disc 226 to direct a cooling airflow 210 toward the disc 226 and blade 202*b*. FIG. 2B is a top-down or radially inward viewed schematic illustration demonstrating the cooling airflow path 210 as it passes through the TOBI 228 and into the blade 202*b* and generating leakage flow 210*a* (also shown in FIG. 2A).

As illustrated in FIGS. 2A-2B, the leakage flow 210*a* re-enters a gaspath C between the vane 202*a* and the blade 202*b*. As specifically indicated in FIG. 2B, the leakage flow 210*a*, because of the orientation of the TOBI 228, enters the gaspath C in substantially the same direction as the direction of flow of the gaspath C. The TOBI 228 is oriented in this fashion such that the airflow leaving the TOBI 228 is in a direction of rotation of the disc $D_R$.

Such leakage flow 210*a* has not been a problem because the TOBI 228 is located in front of the disc 226 and the blade 202*b*, and thus the direction of the leakage flow 210*a* is easily controlled to align cooling air from the TOBI 228 with the rotational direction of the disc $D_R$. As will be appreciated by those of skill in the art, the vane 202*b* at the gaspath C will turn (swirl) the gaspath air in the same direction of the rotating rotor. Likewise, the leakage flow 210*a* in front of the blade 202*b* that is swirled by the TOBI 228, enters the gaspath C in the same tangential flow direction. So when the two flows (gaspath C and leakage flow 210*a*) mix with each other at the inner diameter of the gaspath C, both flows are swirling in the same direction.

However, in engine configurations with the TOBI located behind or aft (and forward facing) of the rotor disc, such unidirectional mixing may not be easily achieved. This is because the TOBI air would still be swirled in the same direction as the rotor. However, the gaspath air exiting the blade will be turned (swirled) to travel in the opposite direction of the rotor. The gaspath air and the leakage air will then meet (at the inner diameter of the gaspath) flowing in opposite tangential directions and will crash into each other. This can generate large mixing losses which is not desirable.

Figure 3A:
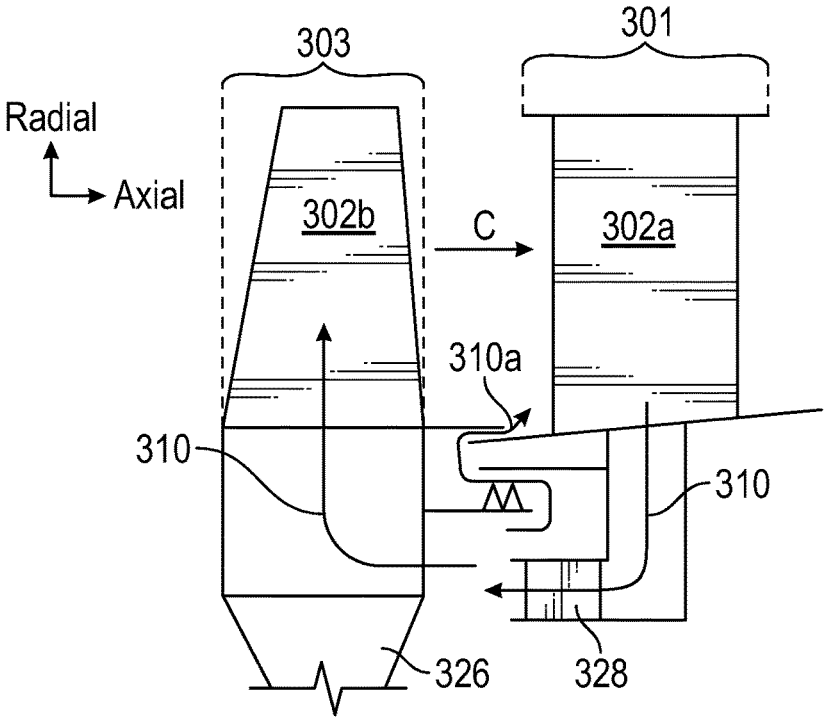
FIG. 3A is a side schematic illustration showing a vane, a blade, and an forward-facing, aft located TOBI in accordance with an embodiment of the present disclosure.
Figure 3B:
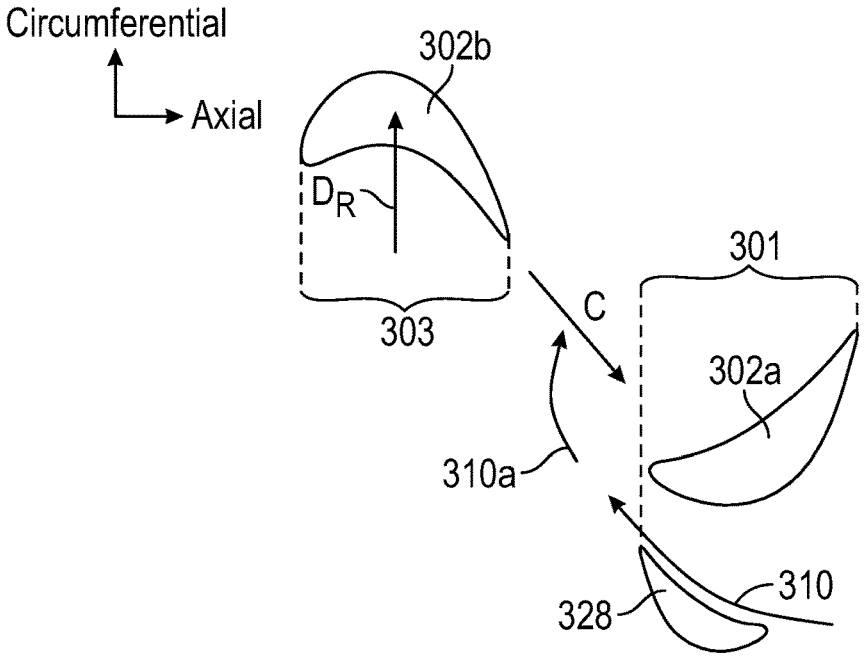
FIG. 3B is a top-down, radially inward viewed schematic illustration of a cooling airflow path as it passes through the arrangement shown in FIG. 3A.

For example, as shown in FIGS. 3A-3B, schematic illustrations of an aft positioned TOBI and associated airflow are shown. FIG. 3A is a side schematic illustration showing a vane 302*a* of a stator section 301 and a blade 302*b* of a rotating section 303 of a turbine of a gas turbine engine. As shown, the stator section 301 is aft of the rotating section 303, and thus the blade 302*b* is forward of the vane 302*a*. The blade 302*b* rotates on a rotor disc 326 in a rotational direction $D_R$ (as shown in FIG. 3B). An aft-positioned, forward facing TOBI 328 is positioned aft of the disc 326 and a cooling airflow 310 passes therethrough to provide cooling air to the disc 326 and the blade 302*b*. FIG. 3B is a top-down or radially inward viewed schematic illustration demonstrating the cooling airflow path 310 as it passes through the TOBI 328 and into the blade 302*b* and generating leakage flow 310*a* (also shown in FIG. 3A).

As illustrated in FIGS. 3A-3B, the leakage flow 310*a* re-enters a gaspath C between the blade 302*b* and the vane 302*a*. As specifically indicated in FIG. 3B, the leakage flow 310*a*, because of the orientation of the TOBI 328, enters the gaspath C substantially perpendicular to the direction of flow of the gaspath C. The TOBI 328 is oriented in this fashion such that the airflow leaving the TOBI 328 is in a direction of rotation of the disc $D_R$.

Such leakage flow 310*a* may cause flow losses because the TOBI 328 is located aft of the disc 326 and the blade 302*b*, and thus the direction of the leakage flow 310*a* is opposing or at least contrary to the rotational direction of the gaspath airflow C. As will be appreciated by those of skill in the art, the TOBI 328 will turn (swirl) the cooling airflow 310 in the same direction of the rotating rotor (rotation direction $D_R$). However, the flow direction of the gaspath C is driven from the blades 320*b* away from the rotation direction $D_R$ because the airflow of the gaspath C is exiting the blades 302*b*. As such, when the two flows (gaspath C and leakage flow 310*a*) mix with each other at the inner diameter of the gaspath C, turbulent mixing may occur that can result in losses.

In order to orient the leakage air entering the gaspath from behind the blade (from an aft positioned TOBI), a secondary TOBI can be positioned between gaspath C and the TOBI 328. That is, the leakage flow can be reoriented or turned by passing through a second TOBI.

Figure 4A:
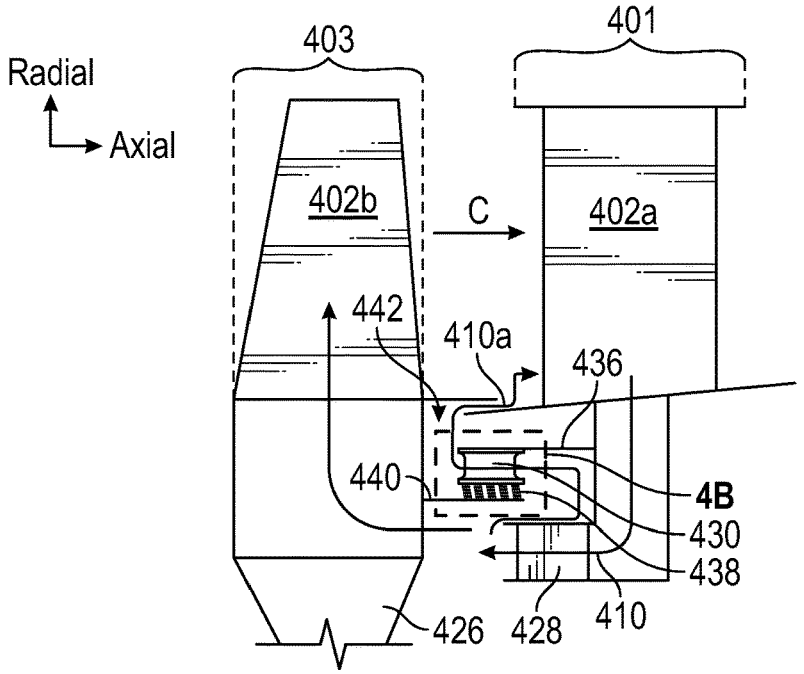
FIG. 4A is a side schematic illustration showing a vane, a blade, and forward-facing, aft located primary and secondary TOBIs in accordance with an embodiment of the present disclosure.
Figure 4B:
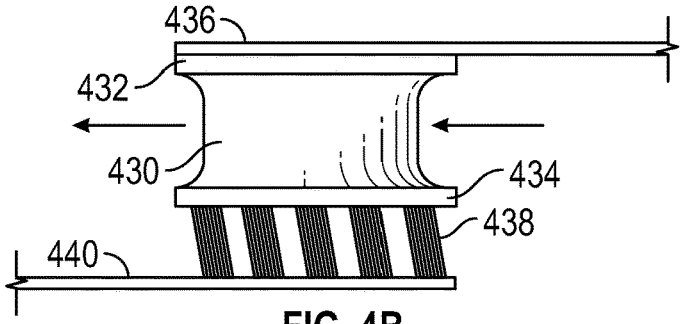
FIG. 4B is an enlarged schematic illustration of the secondary TOBI of FIG. 4A.
Figure 4C:
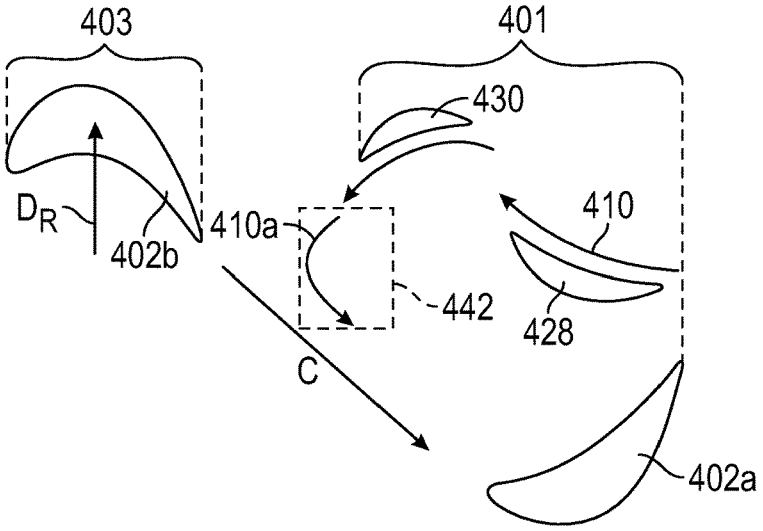
FIG. 4C is a top-down, radially inward viewed schematic illustration of a cooling airflow path as it passes through the arrangement shown in FIG. 4A.

For example, turning now to FIGS. 4A-4C, schematic illustrations of an aft positioned primary TOBI and secondary TOBI and associated airflow are shown. FIG. 4A is a side schematic illustration showing a vane 402*a* of a stator section 401 and a blade 402*b* of a rotating section 403 of a turbine of a gas turbine engine. As shown, the stator section 401 is aft of the rotating section 403, and thus the blade 402*b* is forward of the vane 402*a*. The blade 402*b* rotates on a rotor disc 426 in a rotational direction $D_R$ (as shown in FIG. 4C). An aft-positioned, forward facing primary TOBI 428 is positioned aft of the disc 426 and a cooling airflow 410 passes therethrough to provide cooling air to the disc 426 and the blade 402*b*. Also shown in FIG. 4A, an aft-positioned, secondary TOBI 430 is configured along a path of leakage flow 410*a*. FIG. 4B is an enlarged illustration of the secondary TOBI 430, as indicated in the box 4B of FIG. 4A. FIG. 4C is a top-down or radially inward viewed schematic illustration demonstrating the cooling airflow path 410 as it passes through the primary TOBI 428 and the secondary TOBI 430 and generating leakage flow 410*a* (also shown in FIG. 4A).

As illustrated in FIGS. 4A and 4C, the leakage flow 410*a* re-enters a gaspath C between the blade 402*b* and the vane 402*a*. As specifically indicated in FIG. 4C, the leakage flow 410*a*, because of the orientation of the secondary TOBI 430, enters the gaspath C substantially parallel to the direction of flow of the gaspath C. Similar to the embodiment and configuration shown in FIGS. 3A-3B, the primary TOBI 428 is oriented to direct the airflow leaving the primary TOBI 428 is in a direction of rotation of the disc $D_R$. The secondary TOBI 430 is oriented to thus turn the leakage flow 410*a* to align with the flow direction of the gaspath C. As shown, the secondary TOBI 430 is positioned downstream from the primary TOBI 428.

As shown in FIGS. 4A-4B, the secondary TOBI 430 is positioned between a portion of the vane 402*a* and a portion of the disc 426. For example, as shown, a first wall 432 (e.g., an outer diameter wall as shown) of the secondary TOBI 430 is fixed to a vane element surface 436, such as part of an inner diameter platform of the vane 402*a*. Further, a second wall 434 (e.g., an inner diameter wall as shown) is fitted with a seal 438 that is suited to seal relative to a rotating surface 440 that is part of the disc 426. The seal 438 can be a brush seal, a knife-edge seal, axial non-contact seal, or other rotating or non-rotating seal, as will be appreciated by those of skill in the art. The seal 438 is configured to minimize leakage between the second wall 434 of the secondary TOBI 430 and the rotating surface 440 of a portion of the rotating disc 426. The first wall 432 is fixed to the second wall by a fixed airfoil meant to turn the leakage air in the flow direction of the gaspath flow (i.e., a TOBI airfoil as will be appreciated by those of skill in the art).

In some configurations, the majority of the leakage flow 410*a* enters the secondary TOBI 430 and is de-swirled by the vane inside that secondary TOBI 430, or stated another way, is swirled in the direction of the flow in gaspath C (as shown in FIG. 4C). Since a TOBI (e.g., secondary TOBI 430) minimizes the static pressure of the exiting flow (e.g., leakage flow 410*a*) and, thus, the secondary TOBI could be used as a regulator of the leakage flow 410*a*. Such flow/pressure regulation can eliminate and replace a typical rim cavity seal such as knife edges (e.g., as schematically shown in FIG. 3A).

Also shown in FIGS. 4A and 4C, a rim cavity 442 can be oriented to aid in the direction of the flow of the leakage flow 410*a*. The rim cavity 442 is a cavity formed between portions of the stationary vane 402*a* and the supporting elements thereof and the rotating disc 426 and blade 402*b*. The orientation, geometry, components thereof, etc. of the rim cavity 442 can be arranged to provide additional turning of the leakage flow 410*a* such that the leakage flow 410*a* flows parallel to the direction of the airflow of the gaspath C.

Figure 5:
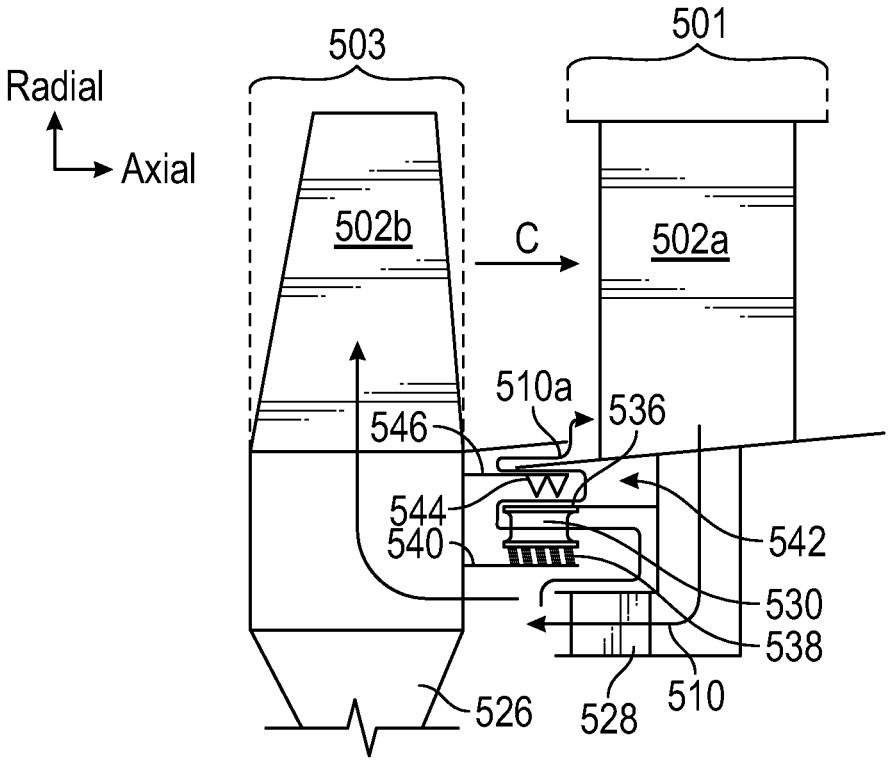
FIG. 5 is a side schematic illustration showing a vane, a blade, and forward-facing, aft located primary and secondary TOBIs in accordance with an embodiment of the present disclosure.

Turning now to FIG. 5, an alternative configuration of an aft positioned primary TOBI 528 and secondary TOBI 530 and associated airflow are shown. FIG. 5 is a side schematic illustration showing a vane 502*a* of a stator section 501 and a blade 502*b* of a rotating section 503 of a turbine of a gas turbine engine. As shown, the stator section 501 is aft of the rotating section 503, and thus the blade 502*b* is forward of the vane 502*a*. The blade 502*b* rotates on a rotor disc 526 in a rotational direction similar to that shown and described above (e.g., into the page of FIG. 5). An aft-positioned, forward facing primary TOBI 528 is positioned aft of the disc 526 and a cooling airflow 510 passes therethrough to provide cooling air to the disc 526 and the blade 502*b*. An aft-positioned, secondary TOBI 530 is configured along a path of leakage flow 510*a*, with a seal 538 arranged to minimize leakage between a second wall of the secondary TOBI 530 and a rotating surface 540 of a portion of the rotating disc 526, similar to that described above.

In this embodiment, a restrictive flow seal 544 is positioned downstream from the secondary TOBI 530 along the flow path of the leakage flow 510*a*. In the embodiment of FIG. 5, the restrictive flow seal 544 is positioned within a rim cavity 542, which can be arranged as described above. The position of the restrictive flow seal 544 is not thus limited, however, and can be positioned anywhere downstream of the secondary TOBI 530. The restrictive flow seal 544 is configured to further reduce the leakage flow 510*a* that leaks into the gaspath C. The restrictive flow seal 544 is a rotating seal that fits between a portion of the rotating disc 526 and a portion of the stationary vane 502*a* (or associated stator components).

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to normal operational attitude and should not be considered otherwise limiting.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

For example, although shown as a single stator section/rotating section pair, those of skill in the art will appreciate that embodiments of the present disclosure can be applied repeatedly within a turbine section of a gas turbine engine such that each stator section/rotating section pair within the turbine includes an aft-positioned, forward facing TOBI. Further, in such embodiments, each aft-positioned, forward facing TOBI can be a primary TOBI and a secondary TOBI can be positioned to redirect a flow direction of leakage flow, as shown and described herein.

Accordingly, the present disclosure is not to be seen as limited by the foregoing description, but is only limited by the scope of the appended claims.

What is claimed is:

1. A turbine comprising:

a stator section having a plurality of vanes;

a rotating section having a plurality of blades, the rotating section being axially adjacent the stator section along an axis of the turbine, the stator section being aftward of the rotating section along the axis of the turbine; and a primary tangential onboard injector located radially inward from the stator section and configured to direct an airflow from the stator section in a forward direction toward the rotating section, the primary tangential onboard injector turning the airflow in a direction of rotation of the rotating section, wherein a leakage flow passes between the stator section and the rotating section and into a gaspath flowing from the blades toward the vanes, the turbine further comprising a secondary tangential onboard injector positioned in a flow path of the leakage flow, wherein the secondary tangential onboard injector has a first wall and a second wall, wherein the first wall is fixed to a vane element surface that is part of the stator section and the second wall is fixed to the first wall by a fixed airfoil meant to turn the leakage air in the flow direction of the gaspath flow, wherein the rotating section includes a rotating seal that forms a seal between a rotating surface of the rotating section and the second wall, and a restrictive flow seal is arranged downstream from the secondary tangential onboard injector along the flow path of the leakage flow.

2. The turbine of claim 1, further comprising a rim cavity defined between the stator section and the rotating section, the rim cavity arranged to turn a leakage flow in a direction of a gaspath flowing from the blades toward the vanes.

3. The turbine of claim 1, wherein the secondary tangential onboard injector turns the leakage flow such that when the leakage flow enters the gaspath, the direction of leakage flow is in a flow direction of a gaspath flow.

4. The turbine of claim 1, wherein the rotating seal is a brush seal, knife edge seal, or axial non-contact seal.

5. The turbine of claim 1, wherein the restrictive flow seal is a brush seal, knife edge seal, or axial non-contact seal.

6. A gas turbine engine comprising:

a compressor section;

a combustor section arranged downstream of the compressor section; and a turbine section arranged downstream of the combustor section, the turbine section comprising:

a stator section having a plurality of vanes;

a rotating section having a plurality of blades, the rotating section being axially adjacent the stator section along an axis of the gas turbine engine, the stator section being aftward of the rotating section along the axis of the gas turbine engine; and a primary tangential onboard injector located radially inward from the stator section and configured to direct an airflow from the stator section in a forward direction toward the rotating section, the primary tangential onboard injector turning the airflow in a direction of rotation of the rotating section, wherein a leakage flow passes between the stator section and the rotating section and into a gaspath flowing from the blades toward the vanes, the turbine further comprising a secondary tangential onboard injector positioned in a flow path of the leakage flow, wherein the secondary tangential onboard injector has a first wall and a second wall, wherein the first wall is fixed to a vane element surface that is part of the stator section and the second wall is fixed to the first wall by a fixed airfoil meant to turn the leakage air in the flow direction of the gaspath flow, wherein the rotating section includes a rotating seal that forms a seal between a rotating surface of the rotating section and the second wall, and a restrictive flow seal is arranged downstream from the secondary tangential onboard injector along the flow path of the leakage flow.

7. The gas turbine engine of claim 6, further comprising a rim cavity defined between the stator section and the rotating section, the rim cavity arranged to turn a leakage flow in a direction of a gaspath flowing from the blades toward the vanes.

8. The gas turbine engine of claim 6, wherein the secondary tangential onboard injector turns the leakage flow such that when the leakage flow enters the gaspath, the direction of leakage flow is in a flow direction of a gaspath flow.

9. The gas turbine engine of claim 6, wherein the rotating seal is a brush seal, knife edge seal, or axial non-contact seal.

10. The gas turbine engine of claim 6, wherein the restrictive flow seal is a brush seal, knife edge seal, or axial non-contact seal.

11. The gas turbine engine of claim 6, further comprising:

a second stator section having a plurality of vanes;

a second rotating section having a plurality of blades, the second rotating section being axially adjacent the second stator section along an axis of the gas turbine engine and aftward of the first stator section, the second stator section being aftward of the second rotating section along the axis of the gas turbine engine; and a second primary tangential onboard injector located radially inward from the second stator section and configured to direct an airflow from the second stator section in a forward direction toward the second rotating section, the second primary tangential onboard injector turning the airflow in a direction of rotation of the second rotating section.

12. The gas turbine engine of claim 11, wherein a leakage flow passes between the second stator section and the second rotating section and into the gaspath, the gas turbine engine further comprising an additional secondary tangential onboard injector positioned in a flow path of the leakage flow between the second stator section and the second rotating section.

* * * * *